US010584937B1

(12) United States Patent
Sims et al.

(10) Patent No.: US 10,584,937 B1
(45) Date of Patent: Mar. 10, 2020

(54) SLING SYSTEM

(71) Applicant: Sims Vibration Laboratory, Inc., Shelton, WA (US)

(72) Inventors: Steven C. Sims, Shelton, WA (US); Jonathan F. Seil, Shelton, WA (US); Arden Merriman, Shelton, WA (US)

(73) Assignee: Sims Vibration Laboratory, Shelton, WA (US)

( * ) Notice: Subject to any disclaimer, the term of this patent is extended or adjusted under 35 U.S.C. 154(b) by 0 days.

(21) Appl. No.: 15/397,560

(22) Filed: Jan. 3, 2017

Related U.S. Application Data

(60) Provisional application No. 62/274,642, filed on Jan. 4, 2016.

(51) Int. Cl.
*F41C 33/00* (2006.01)

(52) U.S. Cl.
CPC ..... *F41C 33/002* (2013.01)

(58) Field of Classification Search
CPC ..... F41C 33/002
USPC ..... 224/150
See application file for complete search history.

(56) References Cited

U.S. PATENT DOCUMENTS 3,334,794 A * 8/1967 Saari ..... F41C 33/00 224/150
3,655,106 A * 4/1972 Wojcinski ..... A45F 5/00 224/150
4,311,263 A * 1/1982 Bianchi ..... F41C 33/002 224/150
4,817,835 A * 4/1989 Tarr, Jr. ..... F41C 33/002 224/150
5,715,979 A * 2/1998 Crandall ..... F41C 23/02 224/150
5,915,939 A * 6/1999 French ..... F41C 23/02 224/150
6,325,258 B1 * 12/2001 Verdugo ..... F41C 33/001 224/149
7,988,023 B1 * 8/2011 Nykoluk ..... F41C 33/002 224/150
8,322,067 B2 * 12/2012 Boord ..... F41C 33/001 224/150
8,832,986 B2 * 9/2014 Mayberry ..... F41C 33/006 224/150
D758,520 S * 6/2016 Quinnan ..... D22/108

OTHER PUBLICATIONS

Prior Art—Titan Sling Swivel, "opticsplanet.com" website, believed to have been published in 2007.

* cited by examiner

*Primary Examiner* — Peter N Helvey
(74) *Attorney, Agent, or Firm* — Wells St. John P.S.

(57) ABSTRACT

The present relates to a sling system, and more specifically, to a sling system which may be used for shoulder mounted sling requirements, such as for rifles, archery bows, cross-bows, weed eaters and metal detectors, to name a few. The sling system includes a shoulder portion with a plurality of columns of slot apertures with each column offset from the adjacent column, an adjustable position handle and couplers on each end of the sling system to couple it to the desired implement or object.

4 Claims, 6 Drawing Sheets

SLING SYSTEM

CROSS REFERENCE TO RELATED APPLICATION

This application claims priority from the prior U.S. Provisional Patent Application Ser. No. 62/274,642, filed Jan. 4, 2016, which is hereby incorporated herein by reference.

TECHNICAL FIELD

The present relates to a sling system, and more specifically, to such a sling system which may be used for numerous shoulder mounted sling requirements, such as without limitation, for carrying rifles, archery bows, crossbows, weed eaters and metal detectors.

BACKGROUND OF THE DISCLOSURE

While the subject matter of this application was motivated in addressing certain of the objectives stated below, it is in no way so limited. The disclosure is only limited by the accompanying claims as literally worded, without interpretative or other limiting reference to the specification, and in accordance with the doctrine of equivalents.

Shoulder slings or straps have been used for many years in many different applications and until now, neither the technology nor the comfort/fatigue issues have really changed or improved in some time. Typically in order to provide the required strength and durability, the prior art slings provide durable but inflexible straps of different configurations and with different degrees of padding over the strap. Over time the prior art slings become uncomfortable, causes shoulder pain, excess sweating and/or other shoulder related issues.

Additionally, the prior art slings or straps have not heretofore been configured to result in as high a degree of comfort, control and/or functionality. Most of the prior art slings or straps do not specifically provide for the user to optimally place and easily maintain the sling and the rifle or other implement being carried. Some of the prior art slings or straps include one adjustment location which never seems to maintain the sling at the optimal length to position the rifle or other implement in an optimally comfortable position on the shoulder of the user.

It is therefore an object of some embodiments of this invention to provide a sling which is readily adjustable including while the shoulder portion of the sling is still on the user's shoulder. This invention uses a strap system that includes an adjustment system, as well as a handle, which makes achieving the optimal position of the sling (and rifle or implement) on the user shoulder at any given time, quicker and easier.

It is also an object of some embodiments of this invention to provide a handle or grip which is adjustably mounted on the strap so that the user has a place to hang on to the sling and to aid in comfortably positioning and controlling the rifle (or other implement) and sling positioning. This invention has the advantage of having a handle (preferably a rubber or polymer) which is slidably mounted over and around the strap combined with a cam lock buckle so the handle can be slid to and fixed in various positions to make the user of the sling more comfortable and in better control of the rifle for example.

In the embodiment of this sling system in which the sling is utilized for carrying rifles, the slings must generally be able to connect to a rifle stud which may be on a swivel, and said rifle stud normally includes a pin aperture. The typical prior art sling or strap utilizes a buckle type arrangement connected at one end to the sling and at the other end to a coupling. The coupling typically includes a pin which is inserted through the pin aperture in the swivel or stud on the rifle and thereafter screwed into a second component of the coupling. It can be unnecessarily inconvenient or difficult to insert the typical screw type pin through the pin aperture in the swivel connection of the rifle and then screw it into the coupling.

It is therefore an object of some embodiments of this invention to provide an improved sling coupler for use in attaching slings to rifles and other implements which include a pin aperture. An aspect of some embodiments of this invention utilizes a quick attachment and quick release configuration which allows the sling to easily and quickly be attached and detached from the rifle or other implement.

While the invention was motivated in addressing some objectives, it is in no way so limited. The invention is only limited by the accompanying claims as literally worded, without interpretative or other limiting reference to the specification, and in accordance with the doctrine of equivalents. Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

DETAILED DESCRIPTION OF THE EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
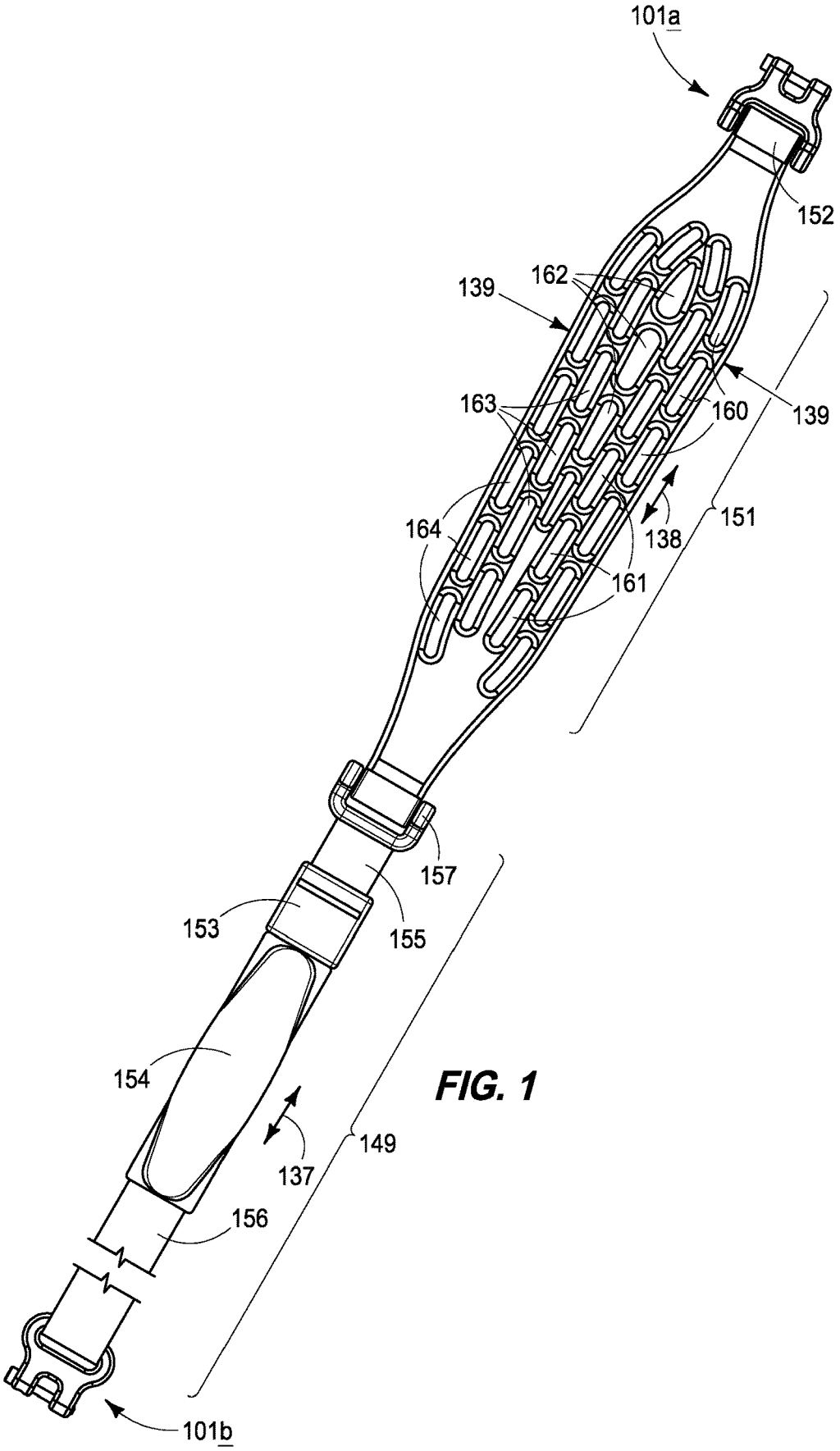
FIG. 1 is a front elevation view of one example of an embodiment of this sling system invention which may be utilized in combination with a rifle or other implement.

FIG. 1 is a front elevation view of one example of an embodiment of this sling system invention which may be utilized in combination with a rifle or other implement. FIG. 1 illustrates a sling with a shoulder portion 151, the shoulder portion 151 including a first end configured to attach to a coupler 101*a* and a second end configured to attach to a strap system 149. The first end of the strap system 149 is attached via buckle 157 to the second end of the shoulder portion 151 and the second end of the strap system 149 is attached to a coupler 101*b*. Handle 154 is shown mounted to the strap system 149, which in this embodiment is mounted around a strap within the strap system such that strap extends through an internal strap aperture in the handle 154.

FIG. 1 further shows two swivel couplers 101*a* and 101*b*, one generally at each end of the sling, for attaching the sling to an implement such as a rifle, bow, crossbow, weed eater, metal detector, etc. Shoulder portion 151 is shown operably attached to coupler 101*a* at a first end and operably and adjustably attached to first strap portion 155 at a second end of shoulder portion 151 via adjustment buckle 157. Handle 154 is shown in this embodiment as mounted on the strap system in that a strap of the strap system extends through an internal strap aperture in the handle such that the handle may slide over the strap as shown by arrow 137. A first end of first strap 155 is shown with cam lock buckle 153 mounted thereon, with the cam lock buckle 153 operably attached to the handle 154 and mounted relative to first strap 155 such that engagement of the cam lock buckle 153 fixes the handle 154 relative to the strap system. The second end of the strap system is operably attached to coupler 101*b*.

The handle 154 combines with cam lock buckle 153 to allow the handle 154 to be slid or adjusted over second strap portion 156 (which extends through an internal cavity or slot within handle 154) and fixed in any one of a number of positions desired by the user. The handle is slightly arcuate on the exterior surface and made of a rubber or polymer like material that has some friction or gripping power, so that when the users places his or her hand thereon, it becomes a place for the user to comfortably rest his or her hand and arm, as well as achieving better control over the rifle. The configuration shown in this embodiment allows the user to have his or her hand on handle 154 and operate cam lock buckle 153 to lengthen or shorten the distance between the lower cam swivel 101*b* and the handle of the sling system. For example the user may have his or her hand on handle 154 and release cam lock buckle 153 thereby allowing the handle 154 and cam lock buckle 153 to slide along and over strap portion 155 and second strap portion 156, thereby changing the distance of the handle 154 relative to swivel coupling 101*b*. This quick and easy adjustability may be accomplished while the sling is over the user shoulder instead of being required to remove the entire sling to effectively make the adjustments.

It should be noted that while the sling system illustrated in FIG. 1 may be used in combination with a rifle via the rifle stud (typically a swivel with a pin aperture), the use or application of such sling system is not so limited and may be used in numerous other applications. Some other applications may include utilizing other couplings to attach the opposite ends of the sling system to whatever weapon, tool or implement it is going to be used in combination with (for example, weed eaters, metal detectors, cross bows, archery bows and others), all within the contemplation of this invention.

The shoulder portion 151 of the embodiment of the invention shown in FIG. 1 is configured to flexibly conform to the shoulder of the user. The shoulder portion 151 is preferably constructed of a rubber or a polymer material and includes a plurality of columns of slot apertures to provide the desired flex and conformity to the user's shoulder, making it a more comfortable sling. While the embodiment illustrated in FIG. 1 includes five (5) columns of slot apertures, it should be noted that this invention is not limited to any specific number of columns of slot apertures (depending on the specific application) so long as there are at least two columns. The configuration shown in FIG. 1 allows the shoulder portion 151 to flex in multiple directions, such as in the longitudinal direction as shown by arrow 138, in the lateral direction as shown by arrow 139 and also in the z direction perpendicular to the longitudinal and lateral directions.

The embodiment of the invention illustrated in FIG. 1 shows a first column of slot apertures 160, a second column of slot apertures 161, wherein the first column of slot apertures 160 is offset from the second column of slot apertures 161. FIG. 1 further shows a third column of slot apertures 162 which is offset from the second column of slot apertures 161, a fourth column of slot apertures 163 offset from the third column 162 of slot apertures, and a fifth column of slot apertures 164 in which the slot apertures in the fifth column 164 are offset from the slot apertures 163 in the fourth column.

Figure 2:
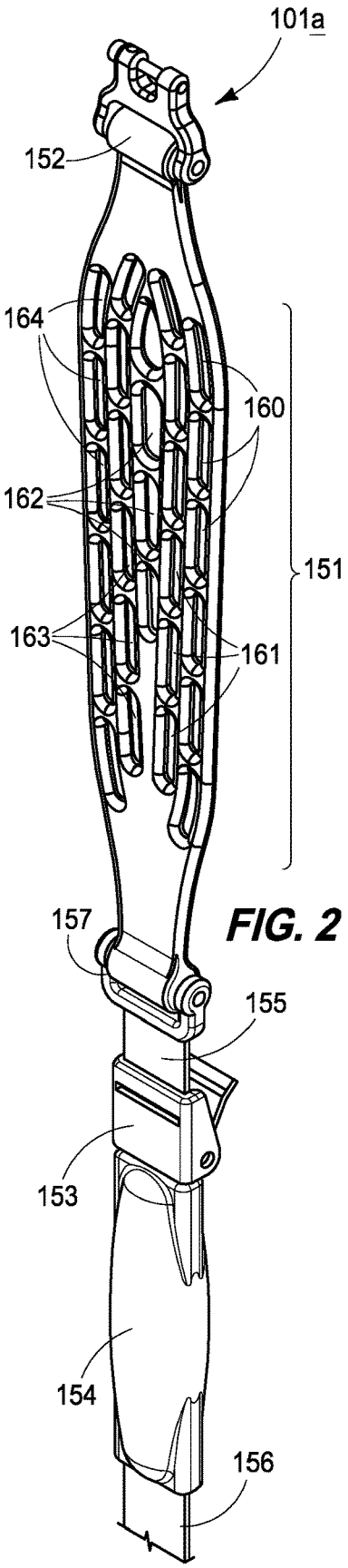
FIG. 2 is a perspective view of the example of the embodiment of this invention as illustrated in FIG. 1.

FIG. 2 is a perspective view of the example of the embodiment of this invention as illustrated in FIG. 1. All like numbered items in FIG. 2 are the same as shown and described relative to FIG. 1, and will not be repeated for FIG. 2.

Figure 3:
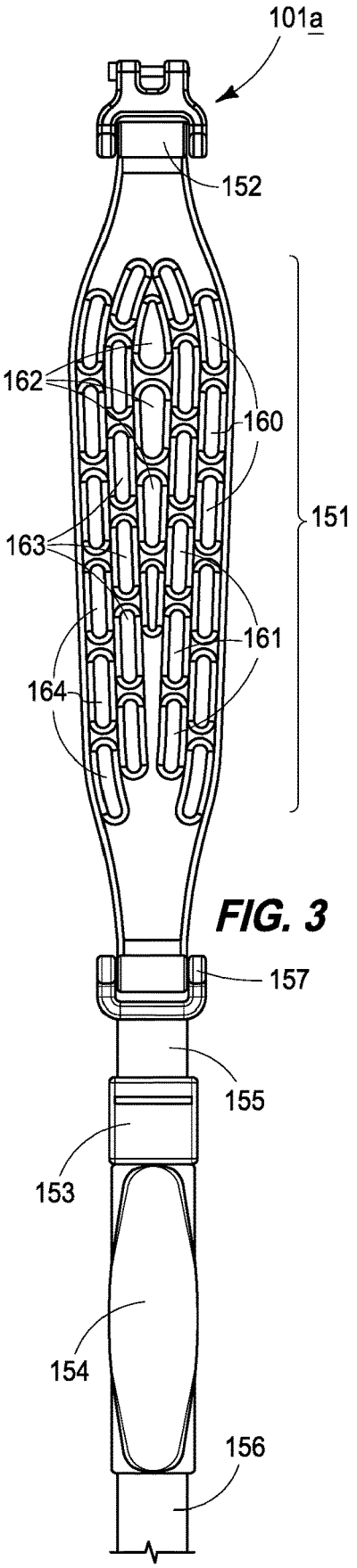
FIG. 3 is an elevation view of the example of the embodiment of this sling system invention illustrated in FIG. 1.

FIG. 3 is an elevation view of the example of the embodiment of this sling system invention illustrated in FIG. 1. All like numbered items in FIG. 3 are the same as shown and described relative to FIG. 1, and will not be repeated for FIG. 3.

Figure 4:
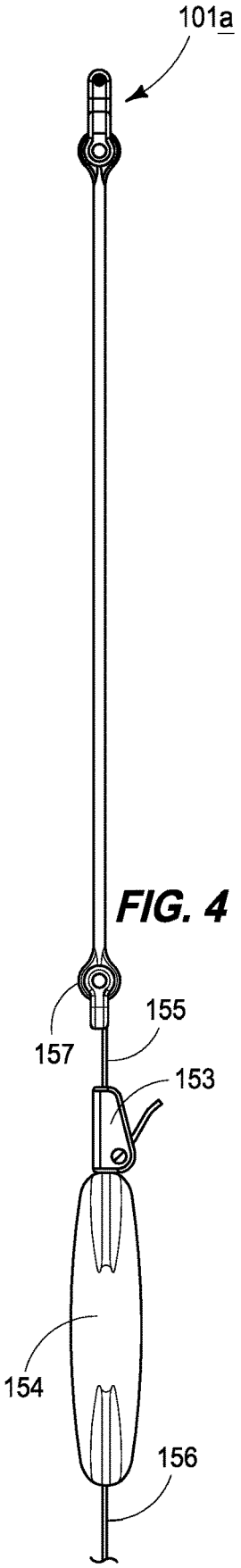
FIG. 4 is a side view of the example of the embodiment of this sling system invention illustrated in FIG. 1.

FIG. 4 is a side view of the example of the embodiment of this sling system invention illustrated in FIG. 1. All like numbered items in FIG. 4 are the same as shown and described relative to FIG. 1, and will not be repeated for FIG. 4.

Figure 5:
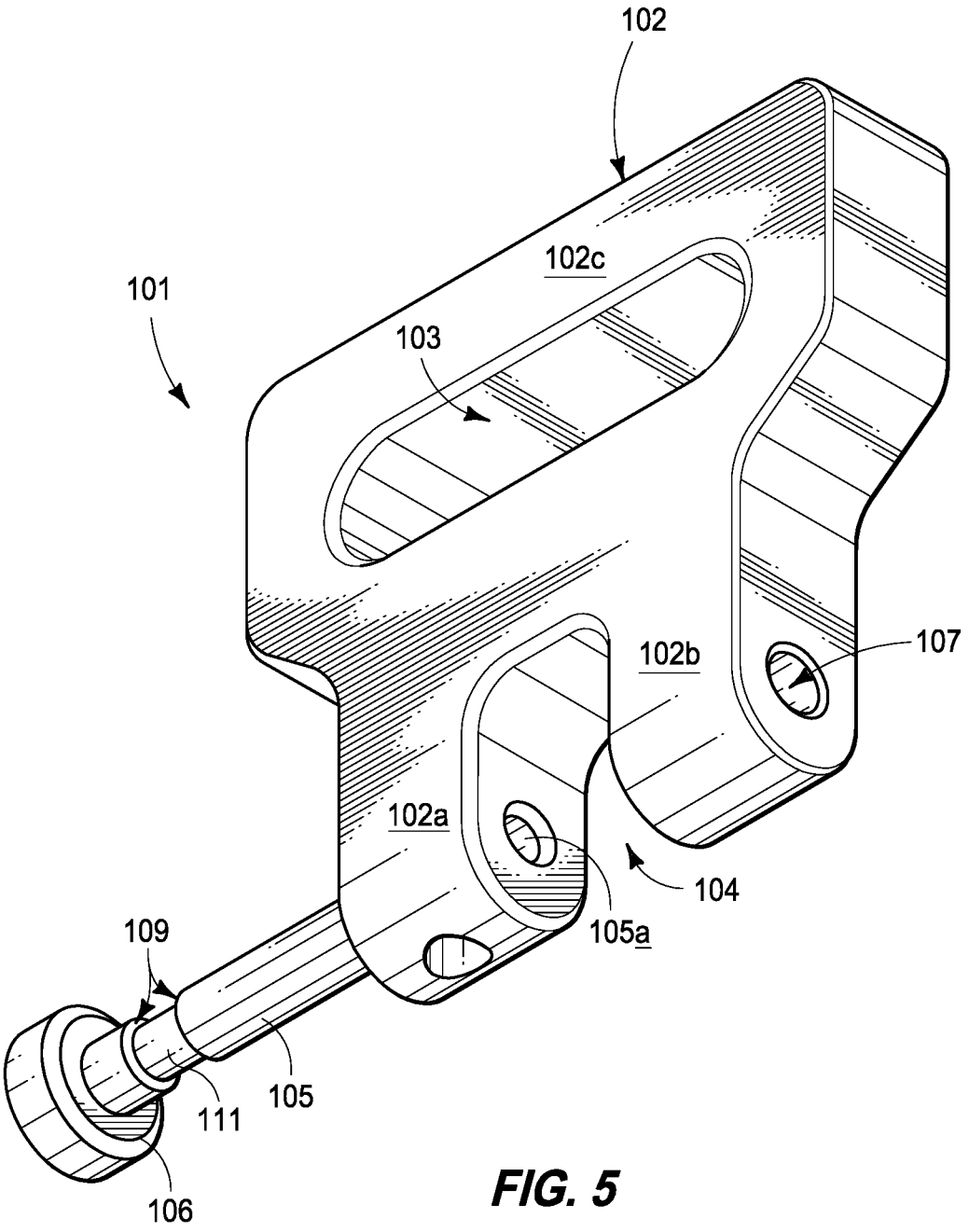
FIG. 5 is a front perspective view of an example of an embodiment of a sling swivel coupler which may be utilized as part of a sling system as disclosed herein.

FIG. 5 is a front perspective view of an example of an embodiment of a quick release sling swivel coupler 101 which may be utilized as part of a sling system as disclosed herein. FIG. 5 illustrates coupler body 102 which is somewhat flat and includes a first end, the sling end 102*c* with sling aperture 103 providing the aperture through which the sling loops through the coupler body 102 to attach the coupler 102 to the sling. The coupler body 102 may have a U-shaped end or outer end (although no particular shape of the stud aperture is required to practice this invention), comprised of first leg 102*a* and second leg 102*b*, with an implement aperture 104 between the first leg 102*a* and the second leg 102*b*. The implement aperture 104 can be configured to accommodate different rifle components (such as a traditional rifle stud with an aperture through the stud) or other implements to which the sling is intended to be attached. In embodiments of this invention in which the invention is to be attached to the attachment point or stud (with an aperture therein) of a rifle, the implement aperture in the coupler body may be referred to as a rifle stud aperture.

A quick attach and detach function of this coupler system 101 makes it very desirable to use and an improvement over the prior art. The sliding pin 105 includes first detent 112 (illustrated in FIG. 7) and second detent 111, with the first and second detents 111 and 112 being reductions in diameter from the main body of the sliding pin 105 as shown. Ridges 109 bridge the distance between the outer diameter of sliding pin 105 and the first detent 111 as shown.

A bore 107 is formed within and aligned between first leg or first side 102*a* and second leg or second side 102*b* of the outer end of the coupler body 102. The bore intersects the implement aperture or rifle stud aperture 104 (in the embodiment directed to rifles) such that the sliding pin 105 may be pushed through the bore 107 illustrated in FIG. 9. There is a spring 121 providing a spring bias or force bias on peg or stop 120, which in turn imparts a force on the sliding pin 105 to hold it in different positions corresponding to the first detent 112 in the second detent 111.

Figure 7:
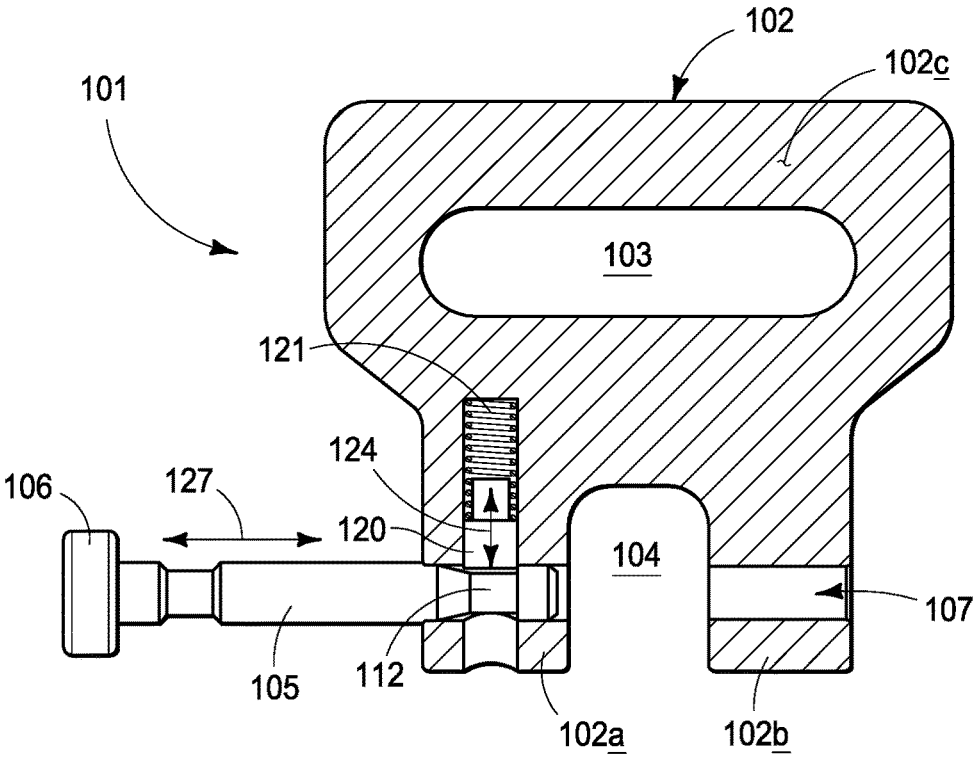
FIG. 7 is section view 3-3 of the example of the embodiment of the sling swivel coupler illustrated in FIG. 6, wherein the attachment pin is in the extended position such that the swivel coupler is in the open position.
Figure 9:
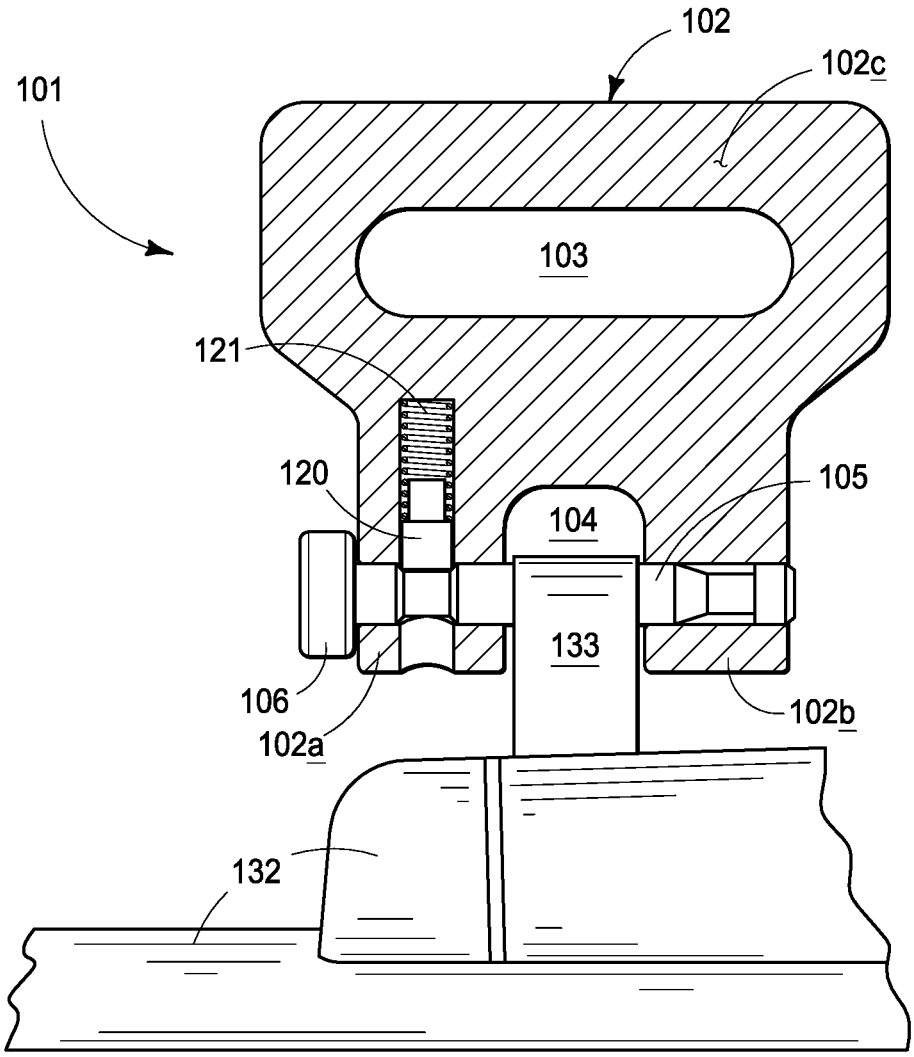
FIG. 9 is section view 3-3 of the example of the embodiment of the sling swivel coupler illustrated in FIG. 6, wherein the attachment pin is in the inserted position such that the swivel coupler is in the closed position such that it secures the sling to the rifle or other implement to which it is attached.

As shown in FIG. 7, when the coupler 101 is in the open position, the spring 121 is placing a force on stop 120 thereby preventing the movement of the sliding pin 105 until sufficient pressure is applied to the end 106 of sliding pin 105 to overcome the downward force of the stop 120. Once the downward force of the stop 120 is overcome, the sliding pin 105 slides through the bore 107 until the stop 120 engages the second detent 111, at which time it provides a sufficient force to temporarily lock the sliding pin 105 in its closed position, as shown in FIG. 9. Arrow 124 represents the movement or potential movement of the stop 120 as the detents in the sliding pin 105 are centered below the stop 120. Arrow 127 illustrates that sliding pin 105 moves in the direction shown through bore 107.

Figure 6:
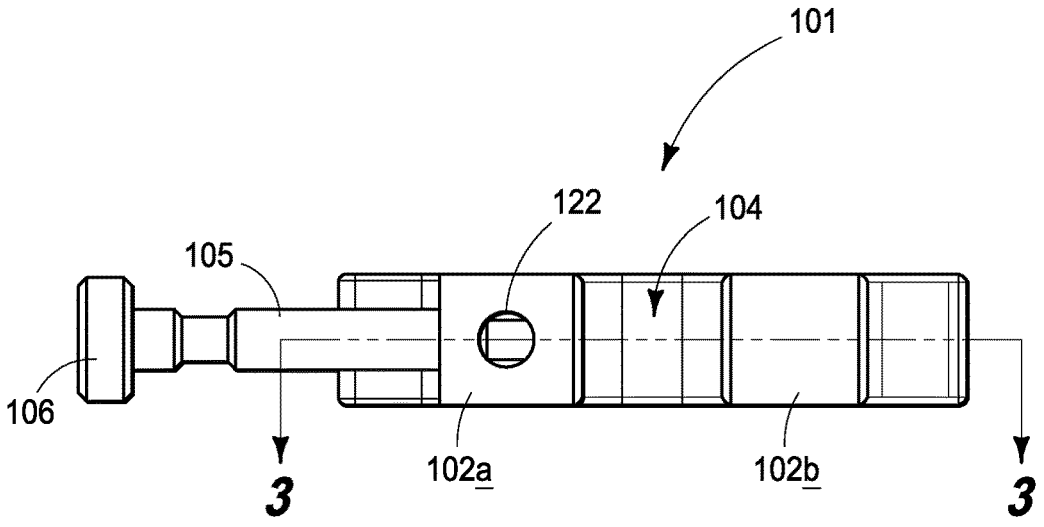
FIG. 6 is a bottom view of the example of the embodiment of the sling swivel coupler illustrated in FIG. 5.

FIG. 6 is a bottom view of the example of the embodiment of the sling swivel coupler illustrated in FIG. 5. All like numbered items in FIG. 6 are the same as shown and described relative to FIG. 5, and will not be repeated for FIG. 6.

FIG. 7 is section view 3-3 of the example of the embodiment of the sling swivel coupler illustrated in FIG. 6, wherein the attachment pin is in the extended position such that the swivel coupler is in the open position. All like numbered items in FIG. 7 are the same as shown and described relative to FIG. 5, and will not be repeated for FIG. 7.

Figure 8:
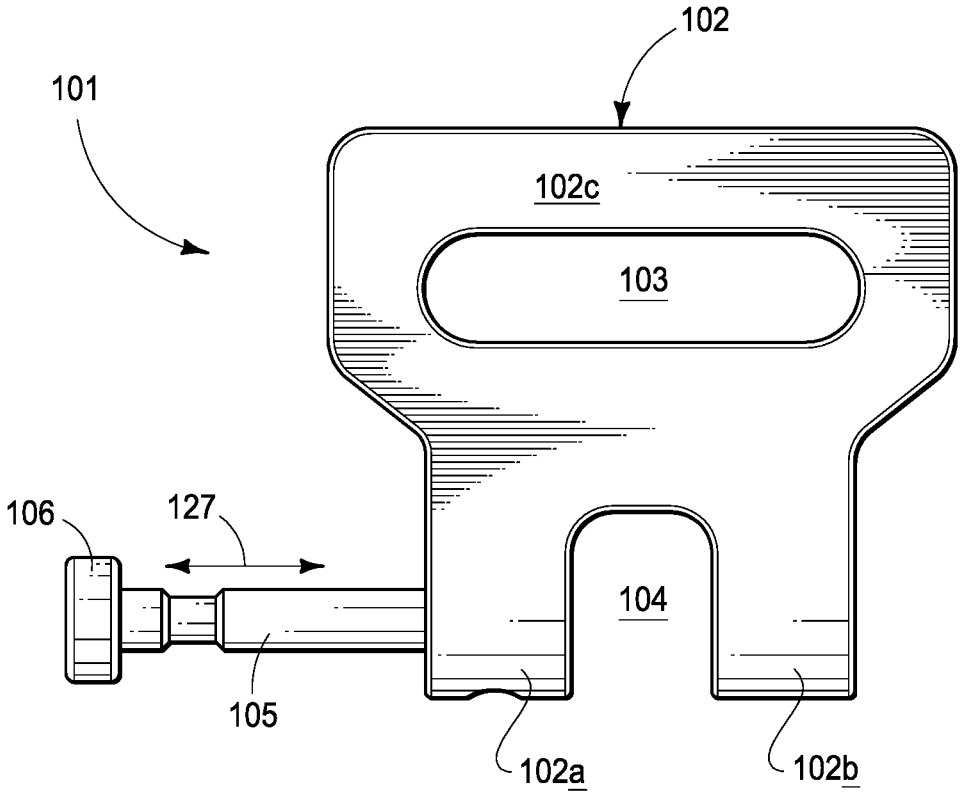
FIG. 8 is an elevation view of the example of the embodiment of the sling swivel coupler illustrated in FIG. 5, wherein the attachment pin is in the extended position such that the swivel coupler is in the open position.

FIG. 8 is an elevation view of the example of the embodiment of the sling swivel coupler illustrated in FIG. 5, wherein the attachment pin is in the extended position such that the swivel coupler is in the open position. All like numbered items in FIG. 8 are the same as shown and described relative to FIG. 5, and will not be repeated for FIG. 8.

FIG. 9 is section view 3-3 of the example of the embodiment of the sling swivel coupler illustrated in FIG. 6, wherein the attachment pin is in the inserted position such that the swivel coupler is in the closed position such that it secures the sling to the rifle or other implement to which it is attached. FIG. 9 shows rifle 132 and rifle stud or swivel 133 inserted within the implement swivel aperture 104 (which may but need not be U-shaped) in coupler 102, and with sliding pin 105 inserted through a corresponding aperture in the rightful swivel 133. All like numbered items in FIG. 9 are the same as shown and described relative to FIG. 5, and will not be repeated for FIG. 9.

As will be appreciated by those of reasonable skill in the art, there are numerous embodiments to this invention, and variations of elements, components and combinations, which may be used, all within the scope of this invention.

One embodiment of this invention, for example, is a sling system comprised of: an elongated sling body comprised of a shoulder portion with a first end and a second end, wherein the shoulder portion is configured to conform to the shoulder of the user, the shoulder portion being constructed of a rubber or a polymer material and includes a first column of slot apertures and a second column of slot apertures wherein the first column of slot apertures is offset from the second column of slot apertures; a strap system which includes a first end and a second end, wherein the first end of the strap system is attached to second end of the shoulder portion; a handle mounted to the strap system and a handle lock configured to fix the handle in a desired location along the strap system; and a first coupler operably attached to the sling body at a first end of the sling body and a second coupler operably attached to the sling body at a second end of the sling body.

Other or additional embodiments may include such a sling system as described in the preceding paragraph and further comprising a third column of slot apertures which is offset from the second column of slot apertures and/or further comprising a fourth and a fifth column of slot apertures, wherein the fourth column of slot apertures is offset from the third column of slot apertures and the fifth column of slot apertures is offset from the fourth column of slot apertures. Further embodiments to that disclosed in the preceding paragraph may be: further wherein the handle lock is a cam lock buckle fixed relative to the handle and on a strap of the strap system and configured to fix the handle in a desired location along the strap system by locking on the strap; and/or further wherein the handle is slidably mounted around a strap of the strap system (or even further wherein the handle lock is a cam lock buckle fixed relative to the handle and on a strap of the strap system and configured to fix the handle in a desired location along the strap system by locking on the strap).

Still further embodiments related to aspects of a coupler which may be utilized may be the sling system as recited in the second preceding paragraph and further wherein the first coupler is comprised of: a coupler body with a sling end, an outer end and two sides, the coupler body including an elongated slot in the sling end configured to receive a sling component there-through; and a rifle stud aperture at the outer end of the coupler body being configured to receive a stud of a rifle; a coupler bore configured through the outer end of the coupler body and intersecting the rifle stud aperture; a sliding pin configured for insertion through the coupler bore, the sliding pin including a first detent and a second detent; a spring aperture lateral to and through the coupler bore; a spring and a stop disposed within the spring aperture such that the spring imposes a bias force on the stop and against the sliding pin; wherein the first detent in the sliding pin corresponds to a first position of the sliding pin in the bore and the second detent corresponds to a second position of the sliding pin in the bore; such that when the stop engages the first detent the sliding pin is held in an open position and when the stop engages the second detent the sliding pin is held in a closed position.

Further embodiments to those disclosed in the preceding paragraph may be further comprised of a third column of slot apertures which is offset from the second column of slot apertures, a fourth column of slot apertures which is offset from the third column of slot apertures and a fifth column of slot apertures which is offset from the fourth column.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A sling system comprised of:

an elongated sling body comprised of a shoulder portion with a first end and a second end, wherein the shoulder portion is configured to conform to the shoulder of the user, the shoulder portion being constructed of a rubber or a polymer material and includes a first column of slot apertures and a second column of slot apertures wherein the first column of slot apertures is offset from the second column of slot apertures;

a strap system which includes a first end and a second end, wherein the first end of the strap system is attached to second end of the shoulder portion;

a handle mounted to the strap system and a handle lock configured to fix the handle in a desired location along the strap system;

a first coupler operably attached to the sling body at a first end of the sling body and a second coupler operably attached to the sling body at a second end of the sling body;

and further wherein the first coupler is comprised of:

a coupler body with a sling end, an outer end and two sides, the coupler body including:

an elongated slot in the sling end configured to receive a sling component there-through;

and a rifle stud aperture at the outer end of the coupler body, the rifle stud aperture being configured to receive a stud of a rifle;

a coupler bore configured through the outer end of the coupler body and intersecting the rifle stud aperture;

a sliding pin configured for insertion through the coupler bore, the sliding pin including a first detent and a second detent;

a spring aperture lateral to and through the coupler bore;

a spring and a stop disposed within the spring aperture such that the spring imposes a bias force on the stop and against the sliding pin;

wherein the first detent in the sliding pin corresponds to a first position of the sliding pin in the bore and the second detent corresponds to a second position of the sliding pin in the bore;

such that when the stop engages the first detent the sliding pin is held in an open position and when the stop engages the second detent the sliding pin is held in a closed position.

2. The sling system as recited in claim 1, and further comprising a third column of slot apertures which is offset from the second column of slot apertures.

3. A sling system comprised of:

an elongated sling body comprised of a shoulder portion with a first end and a second end, wherein the shoulder portion is configured to conform to the shoulder of the user, the shoulder portion being constructed of a rubber or a polymer material;

a first coupler operably attached to the sling body at a first end of the sling body and a second coupler operably attached to the sling body at a second end of the sling body;

and further wherein the first coupler is comprised of:

a coupler body with a sling end, an outer end and two sides, the coupler body including:

an elongated slot in the sling end configured to receive a sling component there-through;

and a rifle stud aperture at the outer end of the coupler body, the rifle stud aperture being configured to receive a stud of a rifle;

a coupler bore configured through the outer end of the coupler body and intersecting the rifle stud aperture;

a sliding pin configured for insertion through the coupler bore, the sliding pin including a first detent and a second detent;

a spring aperture lateral to and through the coupler bore;

a spring and a stop disposed within the spring aperture such that the spring imposes a bias force on the stop and against the sliding pin;

wherein the first detent in the sliding pin corresponds to a first position of the sliding pin in the bore and the second detent corresponds to a second position of the sliding pin in the bore;

such that when the stop engages the first detent the sliding pin is held in an open position and when the stop engages the second detent the sliding pin is held in a closed position.

4. The sling system as recited in claim 3, and further comprising a third column of slot apertures which is offset from the second column of slot apertures.

* * * * *